US007033069B2

(12) United States Patent
Danielsson et al.

(10) Patent No.: US 7,033,069 B2
(45) Date of Patent: Apr. 25, 2006

(54) MIXING DEVICE

(75) Inventors: Peter Danielsson, Fagervik (SE); Torbjörn Jacobsson, Sundsvall (SE); Dennis Nordgaard, Sundsvall (SE)

(73) Assignee: Metso Paper, Inc., (FI)

( * ) Notice: Subject to any disclaimer, the term of this patent is extended or adjusted under 35 U.S.C. 154(b) by 58 days.

(21) Appl. No.: 10/502,909

(22) PCT Filed: Jan. 16, 2003

(86) PCT No.: PCT/SE03/00054

§ 371 (c)(1),
(2), (4) Date: Jul. 28, 2004

(87) PCT Pub. No.: WO03/064018

PCT Pub. Date: Aug. 7, 2003

(65) Prior Publication Data

US 2005/0083780 A1 Apr. 21, 2005

(30) Foreign Application Priority Data

Feb. 1, 2002 (SE) ..... 0200304

(51) Int. Cl.
*B01F 5/04* (2006.01)

(52) U.S. Cl. ..... 366/173.1; 138/44

(58) Field of Classification Search ..... 366/173.1, 366/173.2, 167.1, 336, 338, 341, 181.5; 48/189.4; 138/44

See application file for complete search history.

(56) References Cited

U.S. PATENT DOCUMENTS 3,409,274 A * 11/1968 Lawton
3,632,090 A * 1/1972 White
2005/0083780 A1* 4/2005 Danielsson et al.

FOREIGN PATENT DOCUMENTS

DE 4224911 A1 * 1/1994
JP 2001-58124 * 3/2005
WO 03/055581 A1 * 7/2005
WO 03/064018 A1 * 8/2005

OTHER PUBLICATIONS

Database WPI, Week 20013, Derwent Publications Ltd., London GB; AN 2001-285907 & JP 2001058124 A(NEC Corp), Mar. 6, 2001.

* cited by examiner

*Primary Examiner*—Charles E. Cooley
(74) *Attorney, Agent, or Firm*—Lerner, David, Littenberg, Krumholz & Mentlik, LLP

(57) ABSTRACT

Apparatus for mixing a fluid with a flowing material is disclosed including a chamber having an inlet for connection to a circular inlet conduit and an outlet for connection to a circular outlet conduit, and a supply conduit for supplying the fluid to the chamber, the inlet having a cross-section which is substantially circular at one end and which continuously transforms to a substantially elongated cross-section at the other end, and the outlet has a cross-section which is substantially circular at one end and which continuously transforms to a substantially elongated cross-section at the other end, and the supply conduit is located between the inlet and the outlet.

8 Claims, 1 Drawing Sheet

MIXING DEVICE

FIELD OF THE INVENTION

The present invention relates to a device for admixing an agent in the form of gas or liquid to a flowing material. More particularly, the present invention relates to a device comprising a chamber with an inlet portion and an outlet portion to be connected to an inlet from a pipe and to an outlet from a pipe, each with a substantially circular cross-section. Still more particularly, the present invention comprises such a device with means for the supply of an agent to the chamber, and in which the material flow passes through the chamber while simultaneously the agent is supplied thereto.

BACKGROUND OF THE INVENTION

During the processing of pulp suspensions, various processing agents are required to be admixed therewith, for example for heating or bleaching purposes. It is thus desired to disintegrate the agent in the pulp while the pulp is simultaneously transported through a pipe. For heating the pulp, steam is supplied, which condenses and thus emits its energy content to the pulp. During bleaching a bleaching agent is supplied, which reacts with the pulp. In connection with the processing of recycled fiber pulp printing ink is separated by means of flotation, which requires that air shall first be disintegrated in the pulp.

In all of these cases, it is difficult to achieve a uniform admixture of the agent to the material flow with low energy addition. During the heating of the pulp by steam supplied to a pulp pipe problems often arise because large steam bubbles develop on the inside of the pipe. When these steam bubbles rapidly condense, condensate bangs are produced, which cause detrimental cavitation in the pipe and downstream equipment. This restricts the amount of steam which can be supplied to the system, and the desired increase in temperature. It is also difficult to obtain an entirely uniform temperature profile in the pulp. For overcoming these problems, a large amount of energy can be supplied in order to thoroughly admix the steam with the pulp. Another variant is to disintegrate the steam at the point of its supply to the pulp or prior thereto. During admixing of a bleaching agent with the pulp, relatively large amounts of energy are used in order to ensure that the bleaching agent is disintegrated and transported to all of the fibers in the pulp suspension. The energy demand is controlled by the bleaching agent to be supplied (reaction speed) and by the phase of the bleaching agent (liquid or gas). The geometry during the supply of bleaching agent in the gas phase is important in order to avoid undesired separation directly after the admixture. Previous solutions of mixing devices without movable parts have had a limited field of application due to their geometric design and their low mixing efficiency.

One object of the present invention is a novel geometric design to solve the problems with high energy addition, poor distribution of agent, and to avoid the risk of plug formation at the through-flow of pulp suspensions.

The present invention is thus based on the following criteria.

Mixing is transport. The agent can be added at a point where there is a long transport distance to the most remote fibers. This means that a large amount of energy must be supplied for transport to all of the fibers. The agent can be added at one or many points with short transport distance to all of the fibers. This means that low or no energy is required for transport to all of the fibers.

A pulp suspension in the higher concentration range, e.g., from 8% to 18%, cannot be subjected to compression without risk of plug formation. This means high requirements on the geometric configuration of the device.

SUMMARY OF THE INVENTION

In accordance with the present invention these and other objects have now been realized by the discovery of apparatus for admixing a fluid with a flowing material comprising a chamber including an inlet portion for connection to a substantially circular inlet conduit and an outlet portion for connection to a substantially circular outlet conduit, and supply means for supplying the fluid to the chamber, the inlet portion having a first end for connection to the substantially circular inlet conduit and a second end, and the outlet portion having a first end for connection to the substantially circular outlet conduit and a second end, the inlet portion having a cross-section which is substantially circular at the first end and which continuously transforms to a substantially elongated cross-section at the second end, the outlet portion having a cross-section which is substantially circular at the first end and which continuously transforms to a substantially elongated cross-section at the second end, and wherein the supply means is located between the inlet portion and the outlet portion. Preferably, the fluid comprises a gas or a liquid.

In accordance with one embodiment of the apparatus of the present invention, the inlet portion and the outlet portion have a substantially constant area from the first end to the second end thereof.

In accordance with another embodiment of the apparatus of the present invention, the apparatus includes throttle means disposed in the chamber between the inlet portion and the outlet portion. Preferably, the throttle means creates a turbulent zone in the chamber, and the supply means is disposed at the beginning of the turbulent zone. In another embodiment, the supply means is disposed at the throttle means.

In yet another embodiment, the supply means is disposed prior to the throttle means in a direction towards the inlet conduit. In yet another embodiment, the supply means is disposed subsequent to the throttle means in a direction towards the outlet conduit.

According to the present invention, a chamber is provided in a pipe with a substantially circular cross-section for the flow of material. The chamber has an inlet portion, the cross-section of which successively transforms from circular to oblong, with a substantially maintained area, and an outlet portion, the cross-section of which successively transforms from oblong to circular, also preferably with a substantially maintained area. About the chamber between the inlet portion and the outlet portion means for the supply of agent are connected.

According to a preferred embodiment of the present invention, the central portion of the chamber, between the inlet portion and outlet portion, is formed with parallel opposed walls, which are united with rounded wall portions. Alternatively, the cross-section of the central portion of the chamber can be elliptical, or it can have some other oblong design.

The transformation from circular to oblong cross-section and from oblong to circular cross-section, respectively, should take place through a certain distance in the direction of flow. The minimum length of this distance is determined by the purpose of the application and the properties of the material flow. The area of the oblong cross-section can be defined for a rectangular shape as the product of height times width. The minimum height of the oblong cross-section is determined by the properties of the flowing material.

The chamber can be completed with a densitary throttle between the inlet portion and outlet portion. Means for the supply of agent can be placed in the narrowest section, which renders the shortest transport distance between the point of addition of the admixed agent and all of the constituents of the flowing material. The addition can take place in the throttling, before the throttling or directly after the throttling.

The material flow passing through the chamber is supplied through an ingoing pipe and is removed through an outgoing pipe. As a result, the geometric change of the cross-section from circular to oblong takes place without any change of area, or with a limited change of area, and the material flow is not subjected to any substantial compression. According to the present invention, only a deformation of the flow field of the material flow takes place.

According to current theories for pipe flow, the flow rate at the pipe wall is zero. These theories imply that there arises a rate gradient over the cross-section of the pipe. When this rate gradient reaches a certain size, the pipe flow transforms from a laminar state to a turbulent state in viscous materials. According to the present invention, this phenomenon is utilized in that the minimum height of the oblong cross-section is determined so that transformation from a laminar state to a turbulent state for the definite material takes place. By placing a densitary throttling in the chamber, the material flow can additionally be affected, and alternatively the throttling effect can be utilized for making the mixing device smaller. By creating the geometry so that transformation from a laminar state to a turbulent state takes place, an efficient admixing of the agent is obtained when the agent is added in the turbulent zone.

BRIEF DESCRIPTION OF THE DRAWINGS

The present invention is described in greater detail in the following detailed description which, in turn, refers to the accompanying Figures illustrating different embodiments of the invention, in which.

DETAILED DESCRIPTION

Figure 1:
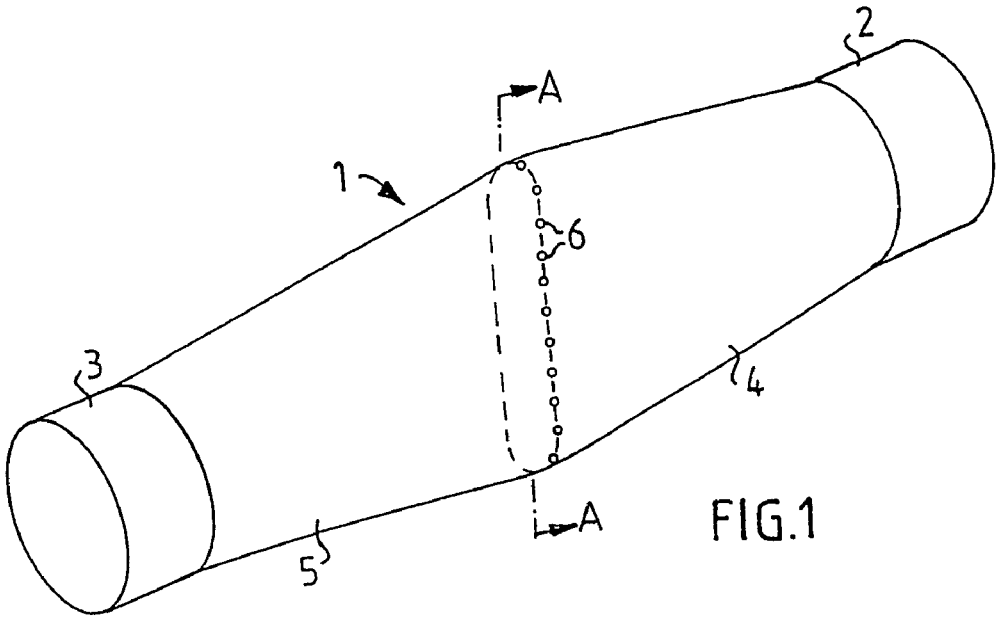
FIG. 1 is a side, perspective view of one embodiment of the device according to the present invention.

FIG. 1 shows a chamber 1, which is connected to an ingoing pipe 2 and an outgoing pipe 3 for a flow of material. These pipes, 2 and 3, have circular cross-sections and are connected to an inlet portion 4 and an outlet portion 5 of the chamber 1. The inlet portion 4 has a cross-section, which successively transforms from circular to oblong, with a substantially maintained or constant area, and the outlet portion 5 has a cross-section which successively transforms from oblong to circular with substantially maintained or constant area, as measured in the direction of flow.

According to the embodiment of the present invention shown in the drawings, the inlet portion 4 transcends directly into the outlet portion 5, but the chamber can alternatively have a certain length with a uniform oblong cross-section between the inlet portion and outlet portion.

In the transition from the inlet portion 4 to the outlet portion 5 means 6 for the supply of processing agent are connected all around the chamber 1. These means 6 can suitably consist of a plurality of nozzles, which are uniformly distributed about the periphery of the chamber 1. As mentioned above, admixing of the agent is promoted by the deformation of the material flow caused by the geometric change of the cross-section in chamber 1.

Figure 2:
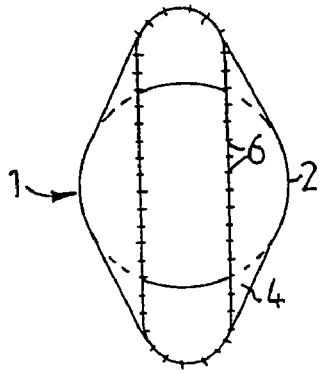
FIG. 2 is a front, elevational view of one embodiment of the device shown in FIG. 1, taken along section A—A thereof.
Figure 3:
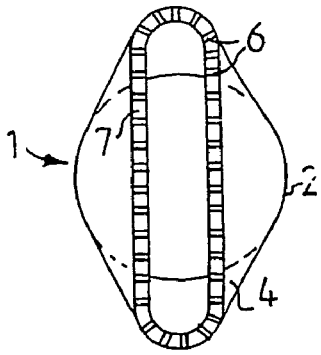
FIG. 3 is a front, elevational view of another embodiment of the device shown in FIG. 1, taken along section A—A thereof.

FIGS. 2 and 3 show by way of cross-section taken along section A—A in FIG. 1 two embodiments, one embodiment (FIG. 2) without densitary throttling in the chamber 1, and a second embodiment (FIG. 3) with a densitary throttling 7 placed in the chamber 1 between the inlet portion 4 and outlet portion 5. Means 6 for the supply of agent are formed as nozzles or oblong slits (not shown in the Figures) directly in the wall of the chamber 1 or in the throttling 7. Alternatively, the means 6 can be placed directly before or after the throttling 7. The throttling 7 creates shear stresses of short duration arise in the material flow through the chamber, which in certain cases can promote the admixing of the agent even more. According to a preferred embodiment of the present invention, the means 6 are placed at the beginning of the turbulent zone formed by the throttling. The means 6 consist of small circular holes with their outlets directed to the material flow.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for admixing a fluid with a flowing material comprising a chamber including an inlet portion for connection to a substantially circular inlet conduit and an outlet portion for connection to a substantially circular outlet conduit, and supply means for supplying said fluid to said chamber, said inlet portion having a first end for connection to said substantially circular inlet conduit and a second end, and said outlet portion having a first end for connection to said substantially circular outlet conduit and a second end, said inlet portion having a cross-section which is substantially circular at said first end and which continuously transforms to a substantially elongated cross-section at said second end, said outlet portion having a cross-section which is substantially circular at said first end and which continuously transforms to a substantially elongated cross-section at said second end, and wherein said supply means is located between said inlet portion and said outlet portion.

2. The apparatus of claim 1 wherein said fluid comprises a gas or a liquid.

3. The apparatus of claim 1 wherein said inlet portion and said outlet portion have a substantially constant area from said first end to said second end thereof.

4. The apparatus of claim 1 including throttle means disposed in said chamber between said inlet portion and said outlet portion.

5. The apparatus of claim 4 wherein said throttle means creates a turbulent zone in said chamber, and wherein said supply means is disposed at the beginning of said turbulent zone.

6. The apparatus of claim 4 wherein said supply means is disposed at said throttle means.

7. The apparatus of claim 4 wherein said supply means is disposed prior to said throttle means in a direction towards said inlet conduit.

8. The apparatus of claim 4 wherein said supply means is disposed subsequent to said throttle means in a direction towards said outlet conduit.

* * * * *